US006786428B1

(12) United States Patent
Huang

(10) Patent No.: US 6,786,428 B1
(45) Date of Patent: Sep. 7, 2004

(54) HOSE REEL WITH A SPRINKLER

(76) Inventor: Guo-Shu Huang, No. 125, Hsihsing E. Rd., Hsihsing Li, Changhua City (TW)

( * ) Notice: Subject to any disclaimer, the term of this patent is extended or adjusted under 35 U.S.C. 154(b) by 186 days.

(21) Appl. No.: 10/251,886

(22) Filed: Sep. 23, 2002

(51) Int. Cl.[7] ..... B65H 75/00

(52) U.S. Cl. ..... 239/198; 239/195; 239/390; 239/197; 242/397.3; 242/395; 137/355.16

(58) Field of Search ..... 239/198, 197, 239/195, 397, 390, 736, 210, 200; 242/397.3, 397.4, 395, 283; 137/355.16, 355.27

(56) References Cited

U.S. PATENT DOCUMENTS 2,578,159 A * 12/1951 Vance ..... 239/198
5,031,838 A * 7/1991 Vydrzal ..... 239/280
5,683,035 A * 11/1997 Wang ..... 239/394

* cited by examiner

*Primary Examiner*—Dinh Q. Nguyen
(74) *Attorney, Agent, or Firm*—Rosenberg, Klein & Lee

(57) ABSTRACT

A hose reel having a casing and a wheel coupled to the casing for winding up a hose, a holder block mounted on the wheel, the holder block having a hose connector for receiving water from a water source through a hose, and a sprinkler carried on the holder block and adapted to sprinkle water received from the hose connector of the holder block on flowers, lawns, etc.

2 Claims, 4 Drawing Sheets

HOSE REEL WITH A SPRINKLER

BACKGROUND OF THE INVENTION

1. Field of the Invention

The present invention relates to a hose reel and, more particularly, to a hose reel provided a sprinkler.

2. Description of the Related Art

When wishing to sprinkle water on flowers, lawns, etc., a sprinkler may be used and connected to a water source by a hose. When the hose separated from the sprinkler, a hose reel may be used to receive the hose. A conventional hose reel is simple a reel for receiving a hose. It cannot be used with the hose to sprinkle water on flowers, lawns, etc.

SUMMARY OF THE INVENTION

It is the main object of the present invention to provide a hose reel, which is equipped with a sprinkler for sprinkling water on flowers, lawns, etc. It is another object of the present invention to provide a hose reel with a sprinkler, which is easy and inexpensive to manufacture. It is still another object of the present invention to provide a hose reel with a sprinkler, which can easily be assembled by the consumer without the use of any fastening elements. It is still another object of the present invention to provide a hose reel with a sprinkler, which is rustproof. According to one aspect of the present invention, the hose reel comprises a casing and a wheel coupled to the casing for winding up a hose, a holder block mounted on the wheel, the holder block having a hose connector for receiving water from a water source through a hose, and a sprinkler carried on the holder block and adapted to sprinkle water received from the hose connector of the holder block on flowers, lawns, etc. According to another aspect of the present invention, a plug joint respectively fastens the parts of the hose reel to one another. According to still another aspect of the present invention, the parts of the hose reel are respectively injection-molded from plastics.

DETAILED DESCRIPTION OF THE PREFERRED EMBODIMENT

Figure 1:
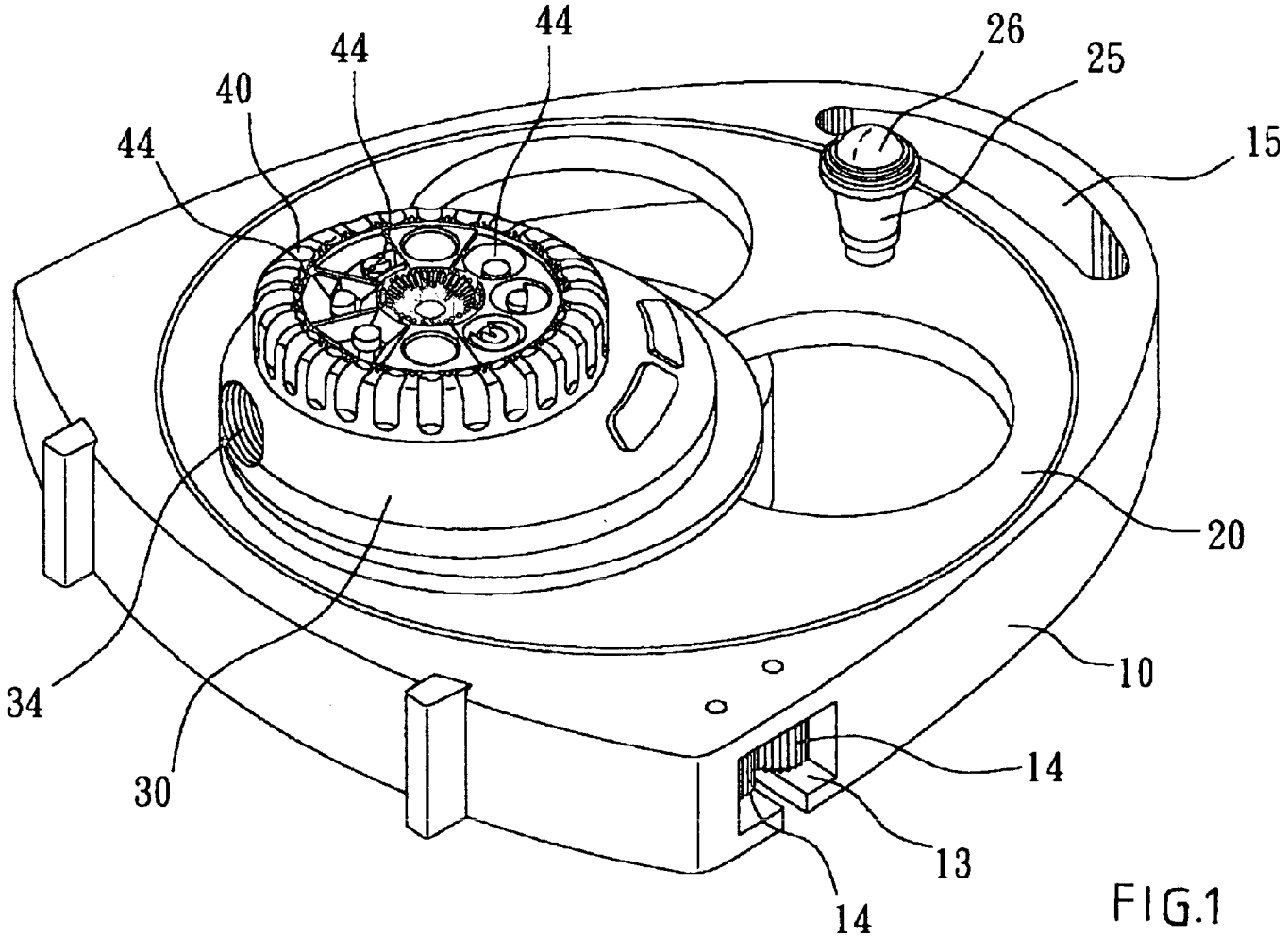
FIG. 1 is an elevational view of a hose reel constructed according to the present invention.

Referring to FIGS. from 1 through 4, a hose reel is shown comprised of a casing 10, a wheel 20, a holder block 30, and a sprinkler 40.

The casing 10 has a circular receiving open chamber 12, a center coupling hole 11 at the center of the closed bottom side of the circular receiving open chamber 12, and an annular guide groove 120 extended around the periphery of the open top side of the circular receiving open chamber 12.

The wheel 20 is supported in the annular guide groove 120 of the casing 10 for free rotation, having a center shaft 21, two plug holes 23, and a mounting hole 24 disposed near the border remote from the plug holes 23. The center shaft 21 has a coupling flange 22 extended around the periphery of the distal end and coupled to the center coupling hole 11 of the casing 10 for enabling the wheel 20 to be rotated in the annular guide groove 120. Further, a handle 26 is fastened to the mounting hole 24 and covered with a soft covering 25 for operation by hand to rotate the wheel 20 in the annular groove 120.

The holder block 30 has two bottom plug rods 32 respectively plugged into the plug holes 23 of the wheel 20, a top coupling hole 31 adapted to receive the sprinkler 40, and a hose connector 34 adapted to receive a hose 1 and to guide water from the hose 1 to the sprinkler 40. The bottom plug rods 32 each have a hooked distal end 33 for positive engagement with the respective plug holes 23 of the wheel 20.

The sprinkler 40 has a bottom center coupling tube 41 inserted into the top coupling hole 31 of the holder block 30, a plurality of jet nozzles 44 for output of water, and a plurality of water passages 43 adapted to guide water from the hose connector 34 of the holder block 30 to the jet nozzles 44. The bottom center coupling tube 41 has a hooked distal end 42 hooked in the top coupling hole 31 of the holder block 30 to fixedly secure the sprinkler 40 to the holder block 30.

The casing 10 further has a peripheral through hole 13 through which the hose 1 can be inserted with its one end into the inside of the casing 10 and fastened to the center shaft 21 of the wheel 20 so that the user can rotate the handle 26 to take up the hose 1.

Two rolls 14 (one hose transfer roll and one impression roll) are provided in the peripheral through hole 13 and arranged in parallel. The hose 1 is inserted through the gap in between the rolls 14. When operating the handle 26 to rotate the wheel 20 and to wound up the hose 1, the hose 1 is compacted by the rolls 14.

The hose reel of the present invention is easy and inexpensive to manufacture. The casing 10, the wheel 20, the holder block 30, and the sprinkler 40 are respectively injection-molded from plastics. Simply by plugging the center shaft 21 of the wheel 20 into the center coupling hole 11 of the casing 10, the bottom plug rods 32 of the holder block 30 into the plug holes 23 of the wheel 20, the bottom center coupling tube 41 of the sprinkler 40 into the top coupling hole 31 of the holder block 30, and the handle 26 into the mounting hole 24 of the wheel 20, the hose reel is assembled without the use of any external fastening means.

When wishing to sprinkle water on flowers, lawns, etc., the hose 1 is taken out of the casing 10 and then connected between the hose connector 34 of the holder block 30 and the water source (not shown) to guide water from the water source to the sprinkler 40, enabling fine drops of water to be forced out of the jet nozzles 44 and sprinkled on the flowers, lawns, etc. Because the casing 10 is shaped like a disk, it can support the hose reel positively on the ground when sprinkling. The casing 10 further has a hanging hole 15 through which the hose reel can be hung on a high place.

When not in use, the hose 1 is detached from the hose connector 34 of the holder block 30 and wound round the center shaft 21 of the wheel 20 inside the circular receiving open chamber 12. Further, the hose 1 is made of fabrics or collapsible material so that it can be compacted when passed through the gap in between the rolls 14.

Figure 2:
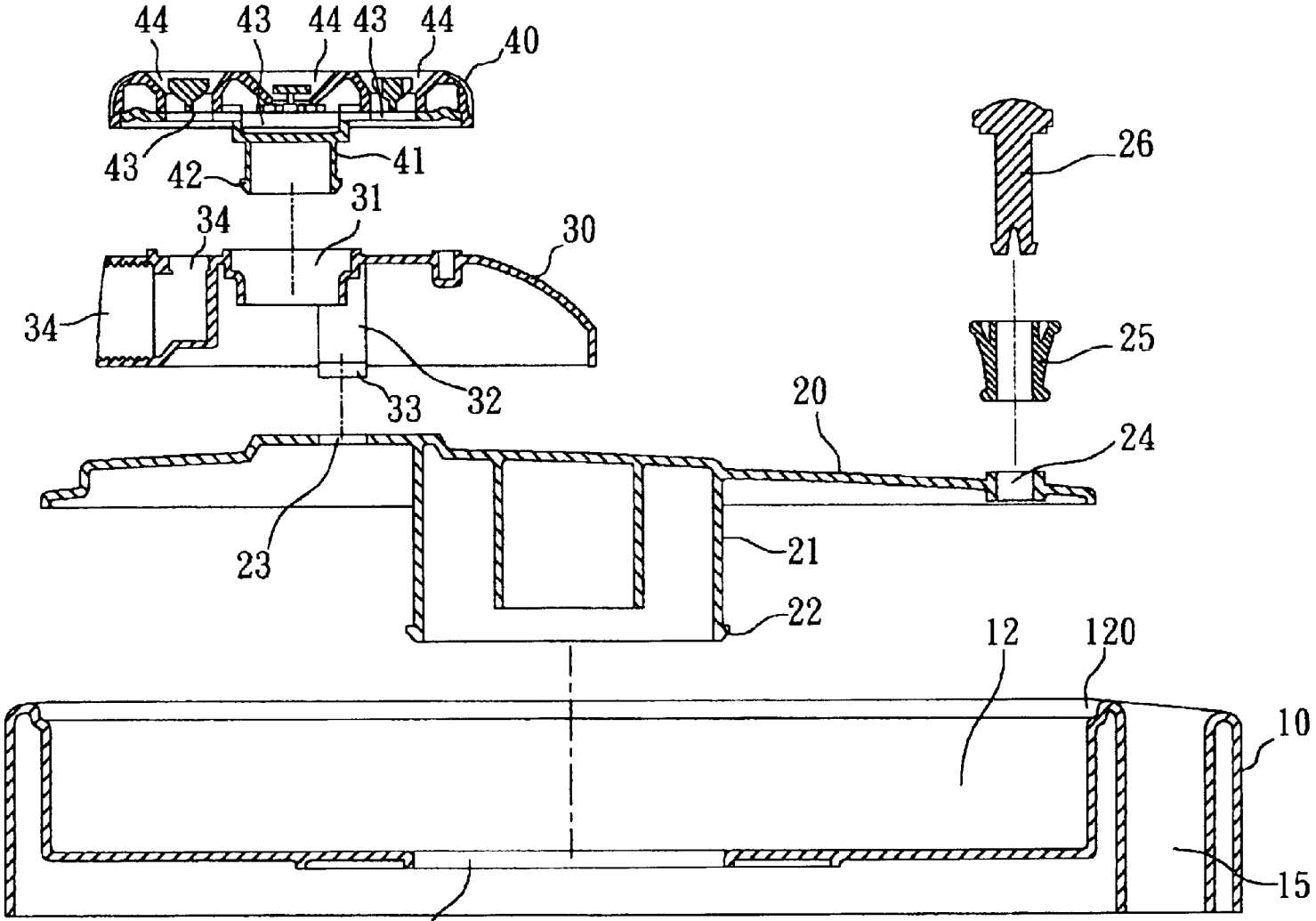
FIG. 2 is an exploded view in section of the hose reel according to the present invention.
Figure 3:
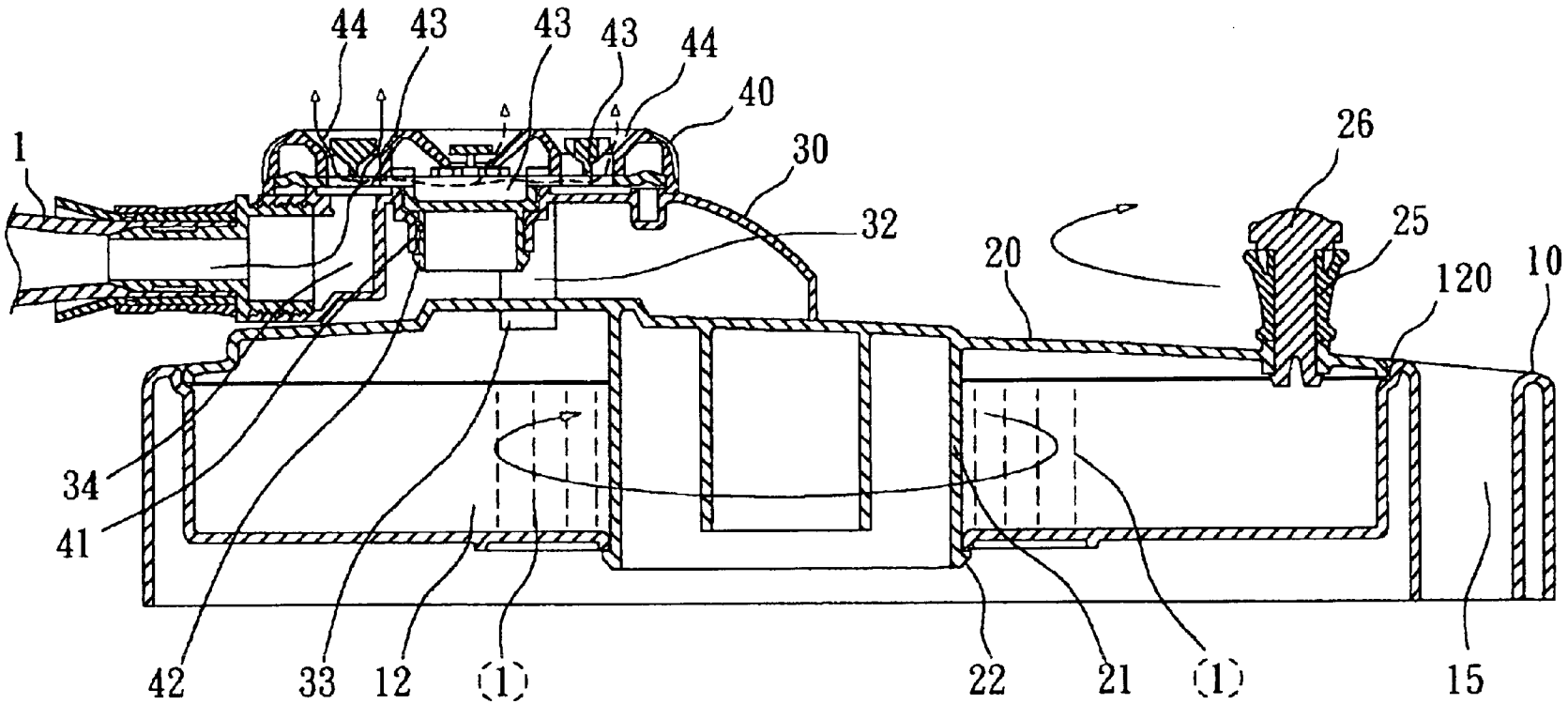
FIG. 3 is a schematic sectional view of the present invention showing the application of the hose reel.
Figure 4:
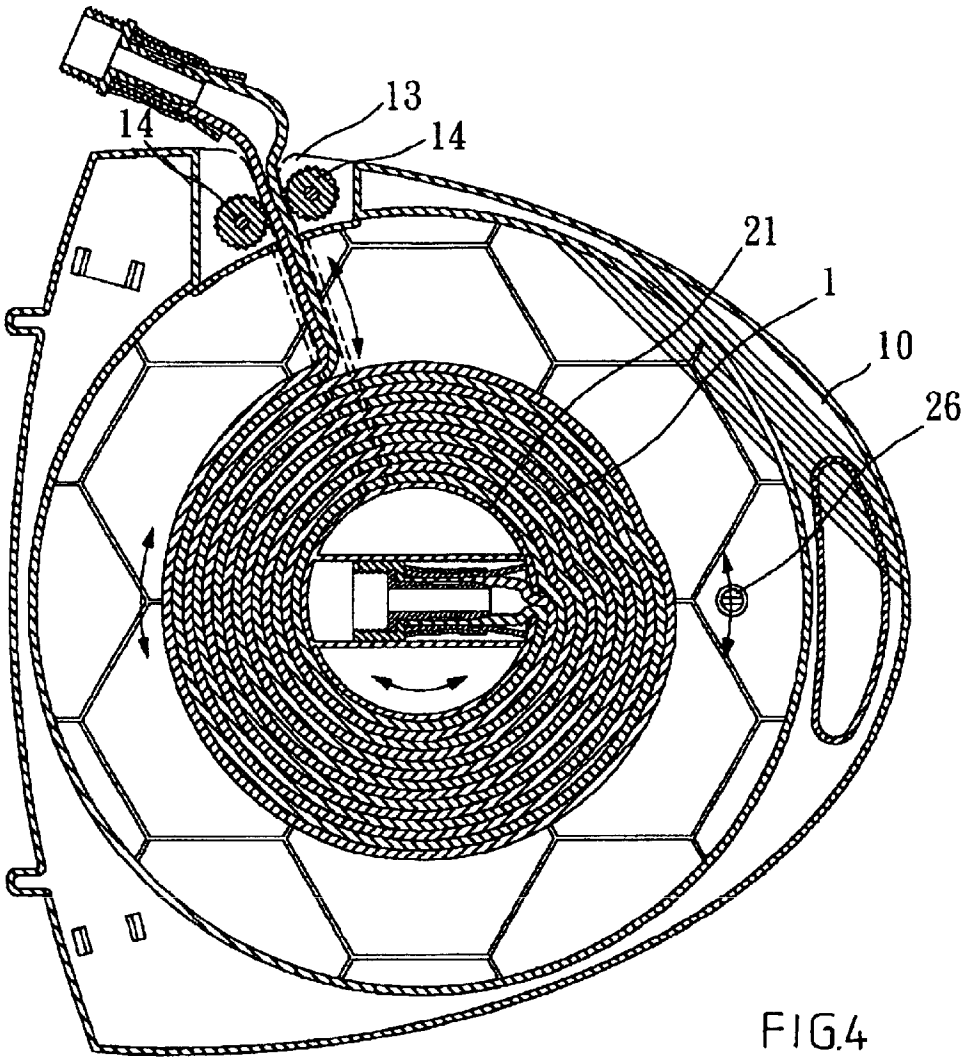
FIG. 4 is a bottom view in section of the present invention, showing the hose received in the hose reel.

A prototype of hose reel with a sprinkler has been constructed with the features of FIGS. 1~4. The hose reel with a sprinkler functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A hose reel comprising:

a casing, said casing having a circular receiving open chamber, a peripheral through hole in communication with said circular receiving open chamber for enabling a hose to be inserted into the inside of said casing and received within said circular receiving open chamber, a center coupling hole at the center of one closed bottom side of said circular receiving open chamber, and an annular guide groove extended around the periphery of an open top side of said circular receiving open chamber;

a wheel supported in the annular guide groove of said casing for free rotation, said wheel having a center shaft suspended in said circular receiving open chamber of said casing for winding up a hose, said center shaft having a coupling flange coupled to the center coupling hole of said casing, two plug holes, and a mounting hole disposed near the border thereof remote from said plug holes;

a handle fastened to said mounting hole of said wheel and covered with a soft covering for operation by hand to rotate said wheel in said annular groove of said casing;

a holder block fastened to said wheel, said holder block having two bottom plug rods respectively fastened to the plug holes of said wheel, a top coupling hole, and the hose connector adapted to receive a hose; and a sprinkler mounted on said holder block, said sprinkler having a bottom center coupling tube coupled to the top coupling hole of said holder block, a plurality of jet nozzles for output of water, and a plurality of water passages adapted to guide water from the hose connector of said holder block to said jet nozzles.

2. The hose reel as claimed in claim 1, wherein said casing has one hose transfer roll and one impression roll provided in said peripheral through hole and arranged in parallel for compacting the hose to be inserted through said peripheral through hole and wound round the center shaft of said wheel.

* * * * *